US006530455B1

(12) United States Patent
Arnette et al.

(10) Patent No.: US 6,530,455 B1
(45) Date of Patent: Mar. 11, 2003

(54) ESCAPE LADDER

(75) Inventors: Henry Arnette, Mebane, NC (US); Judd W. Staples, Chapel Hill, NC (US); Woodrow G. Shaw, Stoney Creek, NC (US)

(73) Assignee: Walter Kidde Portable Equipment, Inc., Meband, NC (US)

( * ) Notice: Subject to any disclaimer, the term of this patent is extended or adjusted under 35 U.S.C. 154(b) by 0 days.

(21) Appl. No.: 09/637,561

(22) Filed: Aug. 11, 2000

(51) Int. Cl.[7] ..... E06C 1/56
(52) U.S. Cl. ..... 182/198; 182/206
(58) Field of Search ..... 182/196–198, 182/206, 175, 176, 23, 25; 16/367

(56) References Cited

U.S. PATENT DOCUMENTS

| | | | | |
|---|---|---|---|---|
| 190,342 A | | 5/1877 | Lake | 182/196 |
| 192,403 A | | 6/1877 | Allen | |
| 314,287 A | | 3/1885 | Fiegenbaum | |
| 647,628 A | | 4/1900 | Heum | |
| 686,182 A | | 11/1901 | Wright | |
| 800,934 A | | 10/1905 | McArthur | |
| 869,151 A | * | 10/1907 | Zube | 182/206 |
| 899,552 A | | 9/1908 | McArthur | |
| 1,098,391 A | | 6/1914 | McArthur | |
| 1,240,653 A | * | 9/1917 | Bell | 182/206 |
| 1,424,115 A | | 7/1922 | Nileon | |
| 2,486,218 A | * | 10/1949 | Snyder | 182/176 |
| 2,615,665 A | * | 10/1952 | Baxter | 182/198 |
| 2,889,099 A | * | 6/1959 | Pulkin | 182/170 |
| 3,068,957 A | * | 12/1962 | Best | 182/176 |
| 3,307,654 A | | 3/1967 | Green et al. | 182/198 |
| 3,385,399 A | * | 5/1968 | Burt | 182/206 |

(List continued on next page.)

FOREIGN PATENT DOCUMENTS

| | | | | |
|---|---|---|---|---|
| AT | 152621 | * | 2/1938 | 182/170 |
| AU | 142760 | * | 8/1951 | 182/170 |
| DE | 2828 211 | | 8/1979 | |
| DE | 196 38 704 | | 4/1998 | |
| FR | 471 433 | | 7/1914 | |
| GB | 1285334 | | 8/1972 | |
| GB | 2230813 | | 10/1990 | |
| SE | 147926 | | 11/1954 | |
| SE | 211210 | | 7/1966 | |
| SE | 211216 | | 7/1966 | |
| WO | WO00/08292 | | 2/2000 | |

OTHER PUBLICATIONS

Kidde Safety Sale Sheet 302065, C–5, Feb. 2000.

Kidde Safety Sale Sheet 300681, B–10, Sep. 1998.

*Primary Examiner*—Alvin Chin-Shue
(74) *Attorney, Agent, or Firm*—Merchant & Gould P.C.

(57) ABSTRACT

An escape ladder provides emergency egress from a dwelling and generally comprises a hook assembly connected to a ladder assembly. The hook assembly includes a pair of laterally spaced clamps and the ladder assembly includes a pair of straps attached to the clamps and a series of rungs extending between the straps. Each clamp comprises an upper hook and a lower hook connected via a hinge. The pair of clamps are connected via a collapsible stabilizer bar. The hinges and stabilizer bar permit the clamps of the hook assembly to be folded and compressed to form an un-deployed configuration of the hook assembly. The rungs are of common cross-sectional shape permitting them to be nested in an un-deployed configuration of the ladder assembly. The escape ladder of the present invention provides secure attachment to the dwelling, folds into an un-deployed package that small and compact for storage, yet is assembled to provide user-friendly deployment that can be reliably deployed in a high stress situation.

18 Claims, 6 Drawing Sheets

U.S. PATENT DOCUMENTS

| | | | | | |
|---|---|---|---|---|---|
| 3,415,341 | A | | 12/1968 | Hostetler | 182/198 |
| 3,464,516 | A | | 9/1969 | Remele | 182/73 |
| 3,547,226 | A | | 12/1970 | Loeffel | 182/164 |
| 3,677,366 | A | | 7/1972 | Leoffel | 182/70 |
| 3,727,724 | A | * | 4/1973 | Gilbert | 182/198 |
| 3,741,340 | A | | 6/1973 | Andrews | 182/196 |
| 4,098,372 | A | | 7/1978 | Luckey | 182/196 |
| 4,157,130 | A | * | 6/1979 | Aberer | 182/198 |
| 4,177,878 | A | | 12/1979 | Salvarezza | 182/199 |
| 4,189,030 | A | | 2/1980 | Leslie et al. | 182/196 |
| 4,241,809 | A | | 12/1980 | Salvarezza | 182/199 |
| 4,243,121 | A | | 1/1981 | Kiss et al. | 182/196 |
| 4,298,097 | A | | 11/1981 | Eriksson | 182/198 |
| 4,442,920 | A | | 4/1984 | Gronbeck et al. | 182/199 |
| 4,554,996 | A | | 11/1985 | Salvarezza | 182/199 |
| 4,655,321 | A | | 4/1987 | Salvarezza | 182/196 |
| 4,692,964 | A | * | 9/1987 | DeBrayn | |
| 4,815,561 | A | | 3/1989 | Ostrander | 182/21 |
| 4,846,306 | A | | 7/1989 | Ventz | 182/196 |
| 4,852,688 | A | | 8/1989 | Strohmeyer, Sr. | 182/199 |
| 5,467,841 | A | | 11/1995 | Krumal | 182/70 |
| 5,605,205 | A | | 2/1997 | Douglas et al. | 182/198 |
| 5,628,380 | A | | 5/1997 | Matisi | |
| 5,799,752 | A | | 9/1998 | Perry | 182/206 |
| 5,842,746 | A | | 12/1998 | Rogers | 297/463.2 |
| 5,971,105 | A | * | 10/1999 | Jacobson | 182/198 |
| 6,279,681 | B1 | | 8/2001 | Dibelardino et al. | 182/198 |
| 6,334,510 | B2 | | 1/2002 | Dibelardino et al. | |
| 6,460,654 | B2 | | 10/2002 | Dibelardino et al. | |

* cited by examiner

FIG. 4
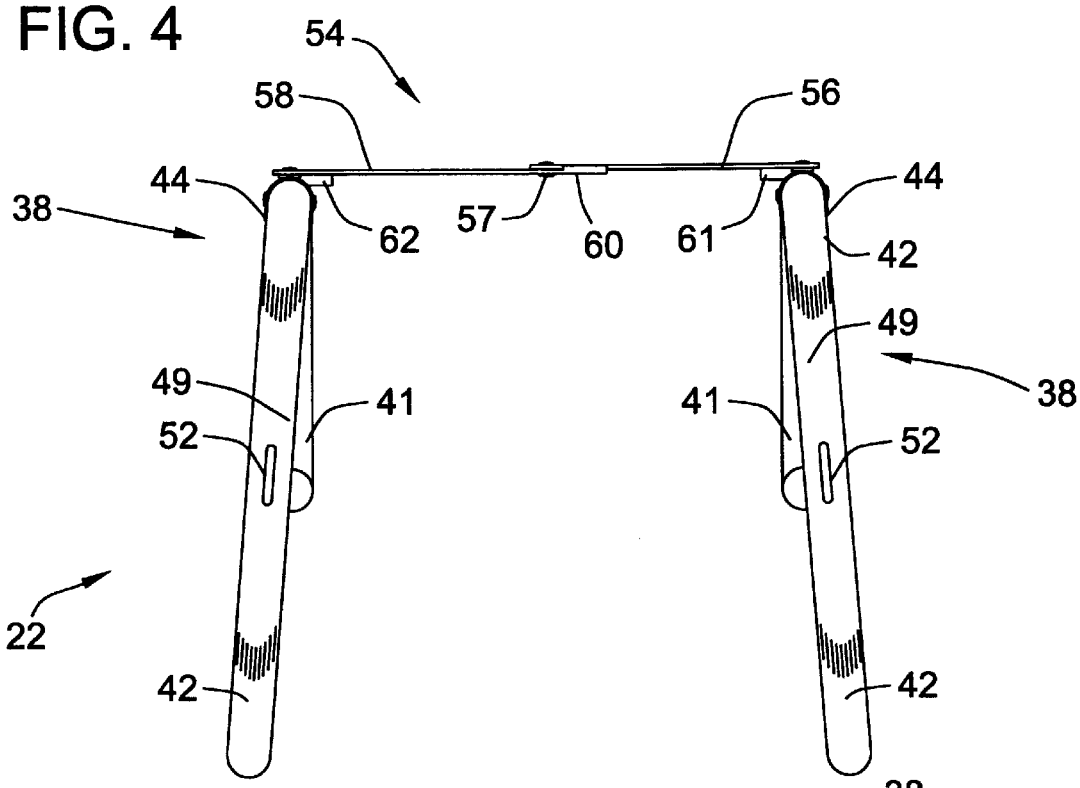
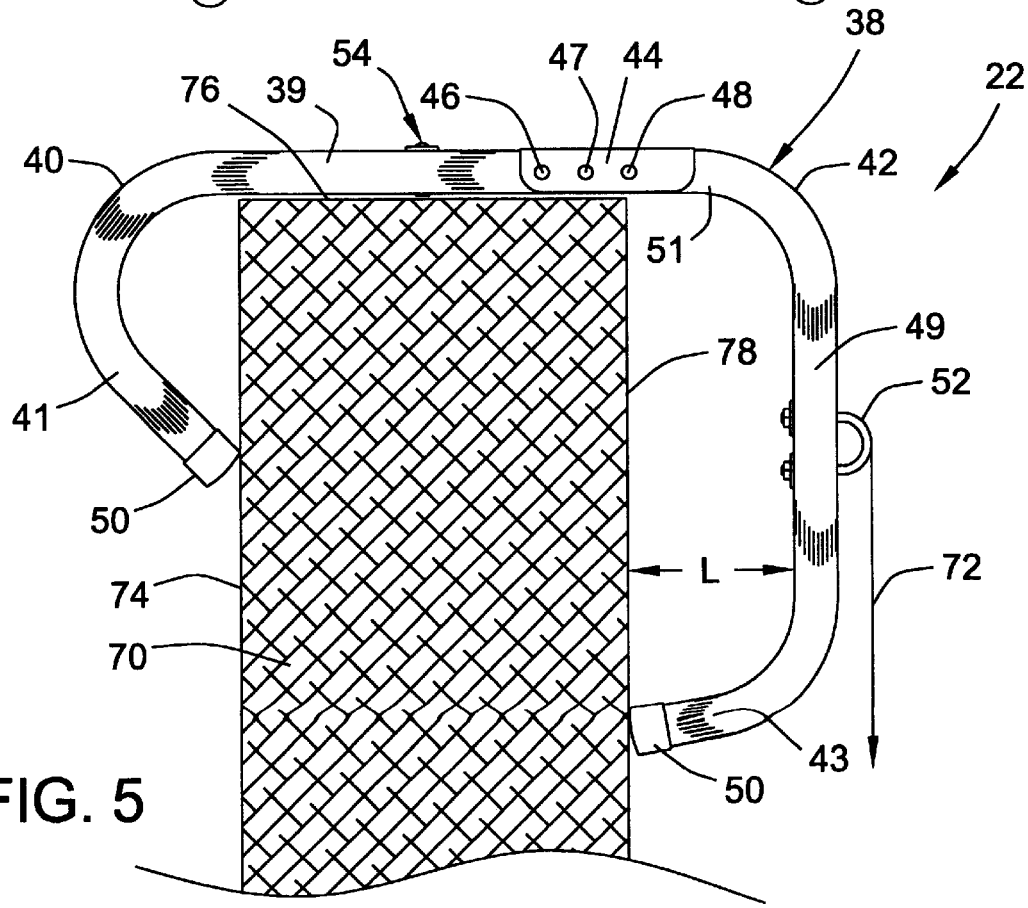
FIG. 5

FIG. 6
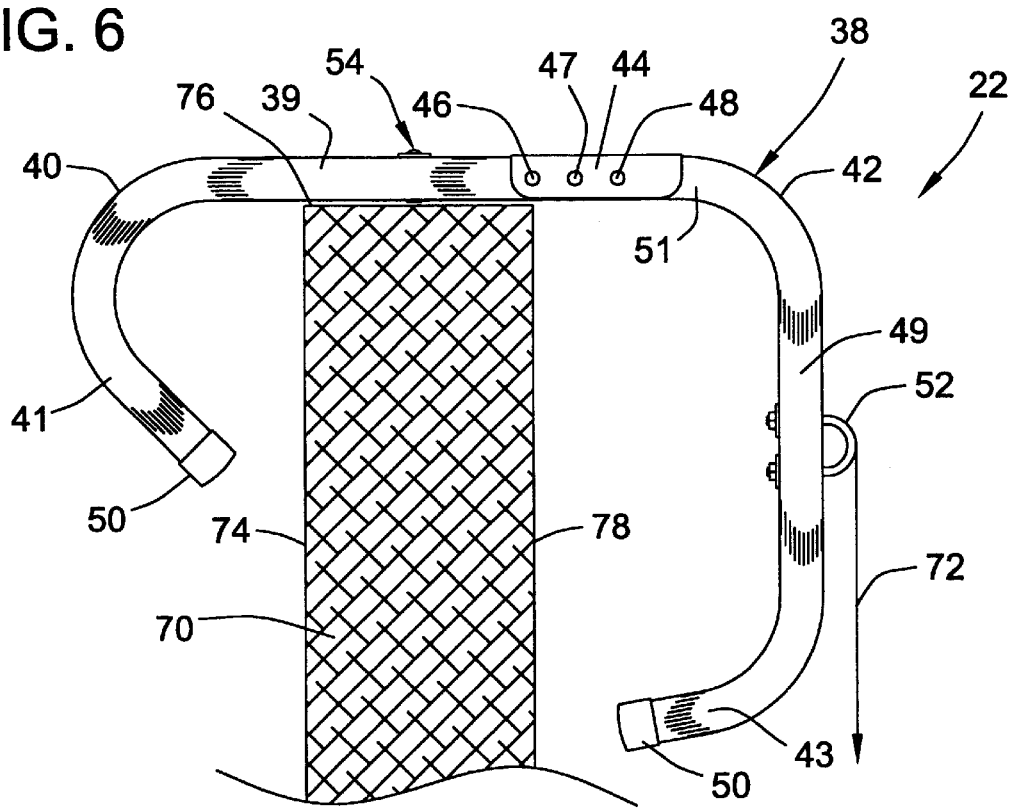
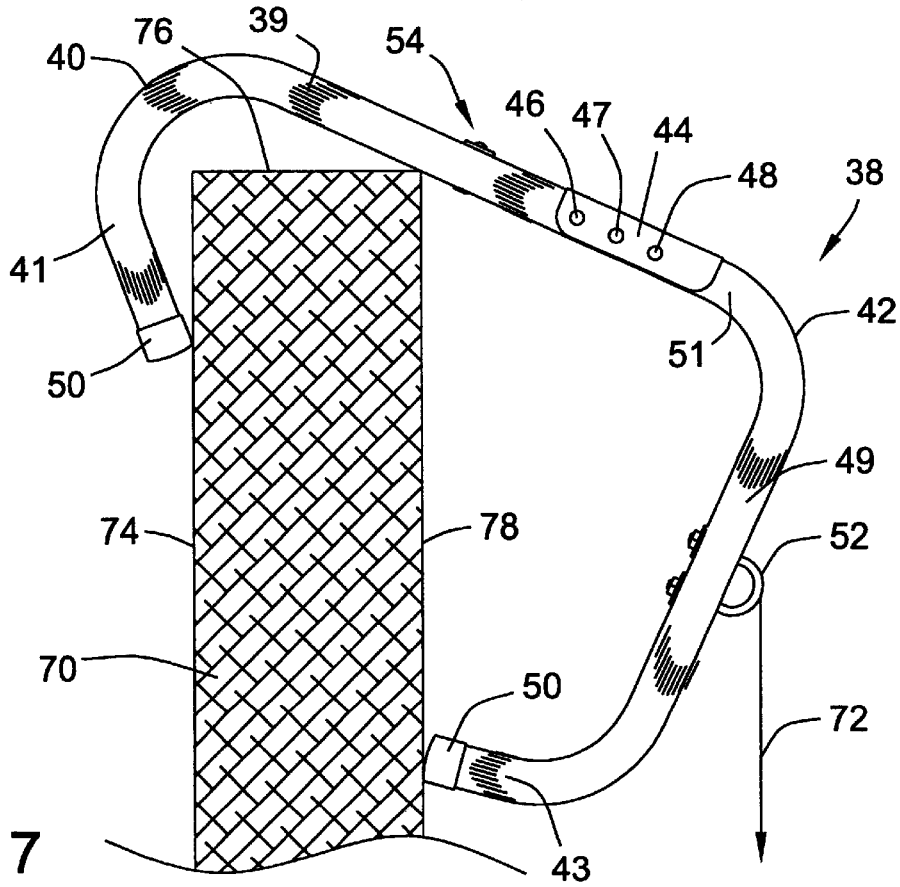
FIG. 7

FIG. 8a
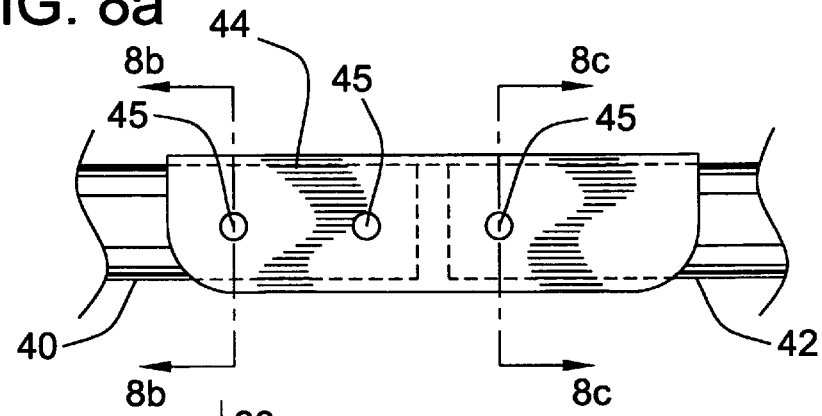
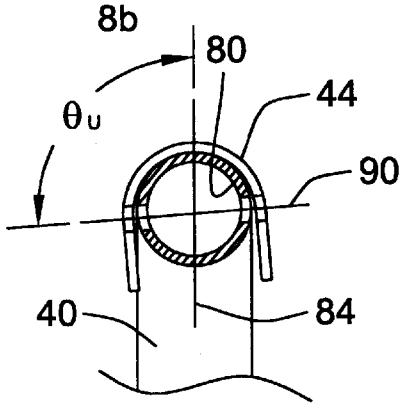
FIG. 8b
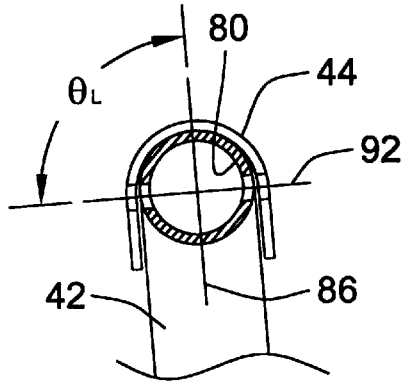
FIG. 8c
FIG. 9
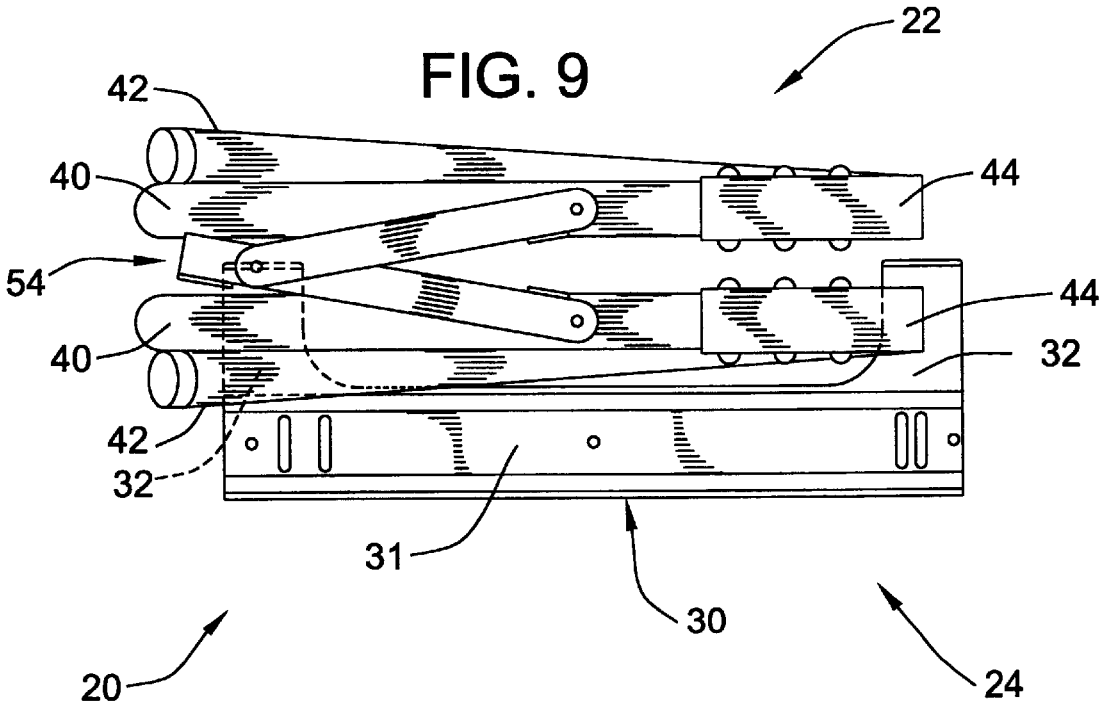

ESCAPE LADDER

FIELD OF THE INVENTION

This invention relates to escape ladders, and more particularly to a safety ladder which is compact for storage, readily deployable, and safe when deployed.

BACKGROUND OF THE INVENTION

A successful safety ladder for the home should be able to meet a number of often-conflicting requirements. Typically the ladders are used for emergency egress from a second story of a home. A typical window represents the exit point, and the safety ladder must be capable of reliably attaching to a rigid structure near the window, and deploying a suspended length of treads through the window to the ground. Among the desirable characteristics are (a) a secure attachment to the building so that it will support the weight of an adult, (b) ready and user-friendly deployment, such that it will be reliably deployed in a high stress situation, (c) a nested and un-deployed condition which is both small for ready storage and assembled to avoid tangles and the like during deployment, and (d) an appearance and mode of deployment which will sufficiently inspire the confidence of a person about to use it.

Various forms of ladders have been devised which are capable of meeting some of these requirements in varying degrees. For example, a number of designs have been provided which utilize metal rungs which have standoffs to space the rung a short distance from a wall, and which have a cross-sectional shape adapted to allow the rungs to be nested. Wires or ropes or woven webbing material have been used to connect such rungs, which ultimately can provide a relatively small rung package. Readily releasably overwrap can be used to hold the rungs in the nested configuration. However, with the miniaturization of the rungs, the tendency is to also miniaturize the hooks which attach the ladder to the wall. Typically, the hooks will simply be placed over the wall at a window opening so that they span from a position just inside the window, over the wall, to a position outside the window. The ladder is suspended from the hooks. It is preferable to avoid the need for special purpose attachments on the wall, because users will attempt to resist those. However, the use of relatively small hooks, while aiding in reducing the size of the un-deployed package, potentially creates the problem of poor retention of the ladder to the structure wall.

Relatively larger hooks have been used with success. For example, the assignee of the present invention has used hooks exemplified in their commercial catalog, published September 1998, page B-10, models KEL-15, KEL-15 PLUS, and KEL-25, which are sufficiently large to reliably engage the wall for support on both the inner and outer faces thereof, and to suspend the ladder from the properly engaged hooks. Hooks of this sort have been used with chain type escape ladders where the rungs are carried on a length of chain, and in the un-deployed condition, the rung/chain package is similar in size to the overall hooks. It would be possible to utilize nested metal rungs with such hooks to provide a safe and secure assembly, but the nested configuration of the package would not attract those consumers who have an interest in minimizing the storage space required for the escape ladder.

SUMMARY OF THE INVENTION

In view of the foregoing, it is a general aim of the present invention to provide a new emergency escape ladder utilizing nested metal rungs and providing the wall-attachment reliability of a large hook design yet reducing the overall size of the nested package.

In that regard, it is an object to provide a hook configuration for such a ladder which in the un-deployed condition is of a size compatible with the nested rungs yet in the deployed condition provides safe and secure attachments to the structure.

It is a feature of the present invention to provide an escape ladder having a hook assembly comprising two laterally spaced clamps that fold into an un-deployed condition that is small as well as being compatible in size with the nested rungs to form an un-deployed package that minimizes the storage space needed for the escape ladder.

It is a further feature to form the clamps of an upper hook and a lower hook which are hinged such that the free ends of the upper and lower hooks can overlap when the hook assembly is in the un-deployed condition to form a small package for storage.

Other objects and advantages of the invention will become more apparent from the following detailed description when taken in conjunction with the accompanying drawings.

BRIEF DESCRIPTION OF THE DRAWINGS

FIG. 4 is a rear view of the preferred embodiment of the hook assembly of the escape ladder.

FIG. 5 is a side view of the hook assembly of FIG. 4 positioned on a wall.

FIG. 6 is a side view of the hook assembly of FIG. 5 positioned on a different wall.

FIG. 7 is a side view of the hook assembly of FIG. 6 repositioned on the wall.

FIGS. 8*a,* 8*b* and 8*c* are side and section views of the preferred embodiment of the hinge of the hook assembly.

FIG. 9 is a side view of the escape ladder of FIG. 2 in an un-deployed condition.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
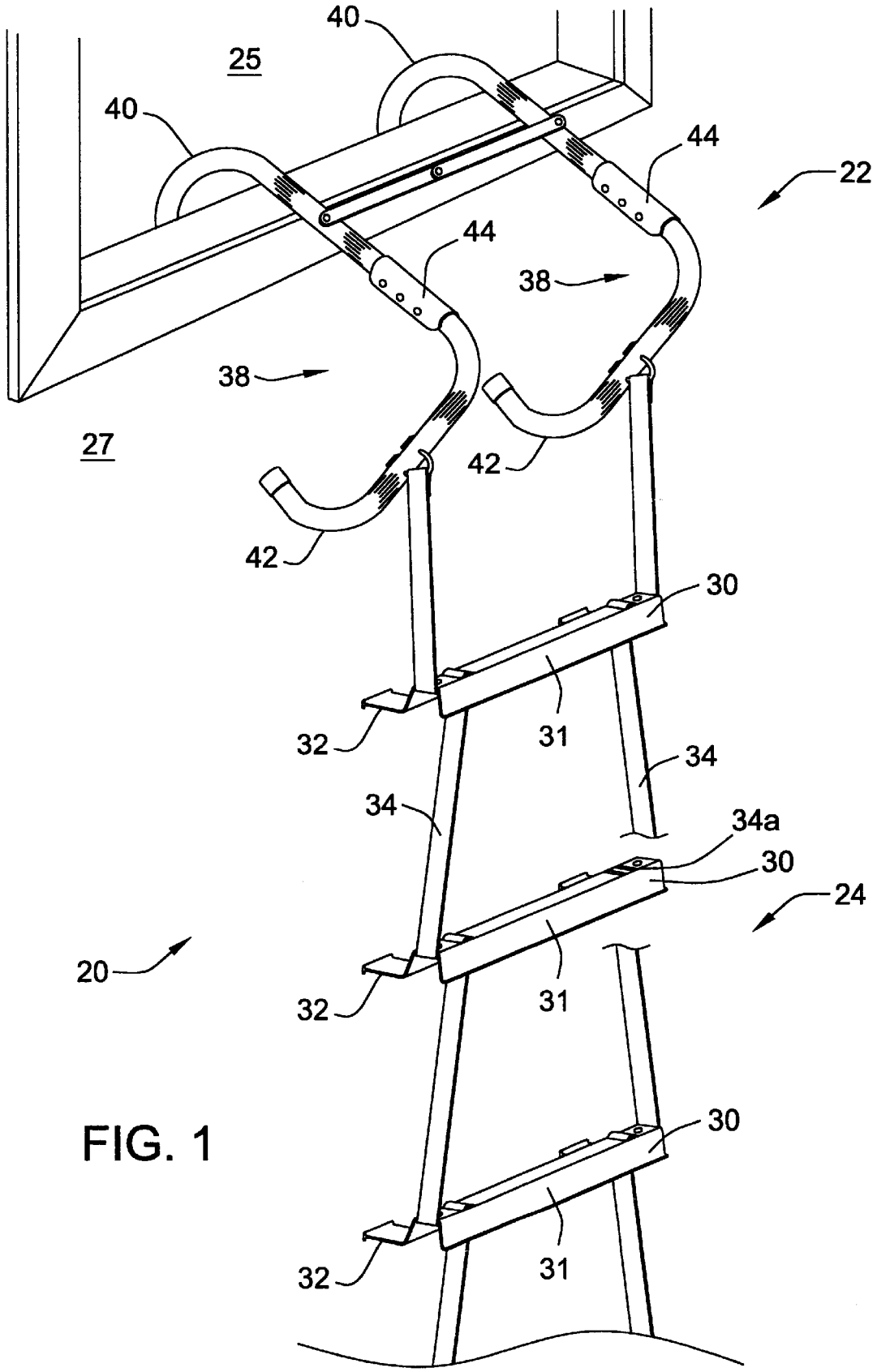
FIG. 1 schematically illustrates the preferred embodiment of the present invention as an escape ladder suspended from a window.

Referring now to the drawings, and with particular reference to FIG. 1. the preferred embodiment of the escape ladder 20 is shown suspended from a wall 27 having a window 25. The escape ladder 20 generally comprises a hook assembly 22 connected to a ladder assembly 24. The hook assembly 22 includes a pair of relatively large laterally spaced wall clamps 38. The ladder assembly 24 includes a pair of woven straps 34 attached to the wall clamps 38, and having a series of rungs 30 extending between the straps 34. While woven straps 34 have been illustrated, other materials such as rope, wire or chain may be employed to connect the rungs 30 in accordance with the present invention. As depicted in FIG. 1, the hook assembly 22 attaches to the wall 27 at the base of window 25, and the ladder assembly extends downward therefrom providing emergency egress.

Figure 2:
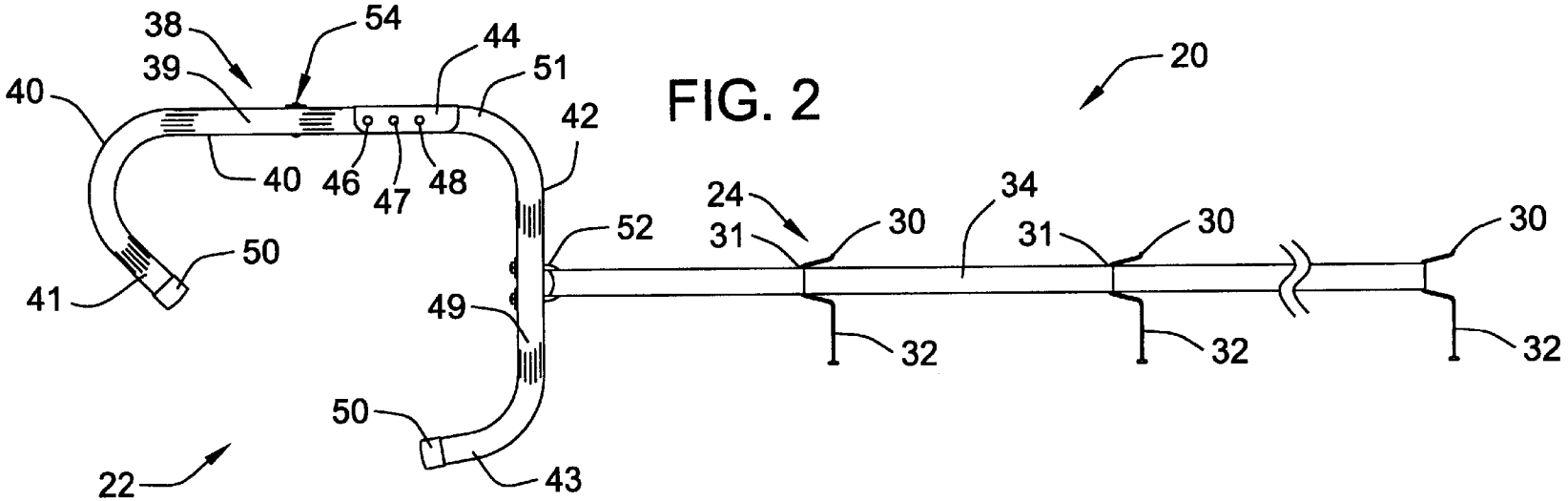
FIG. 2 is a side view of the preferred embodiment of the escape ladder.
Figure 3:
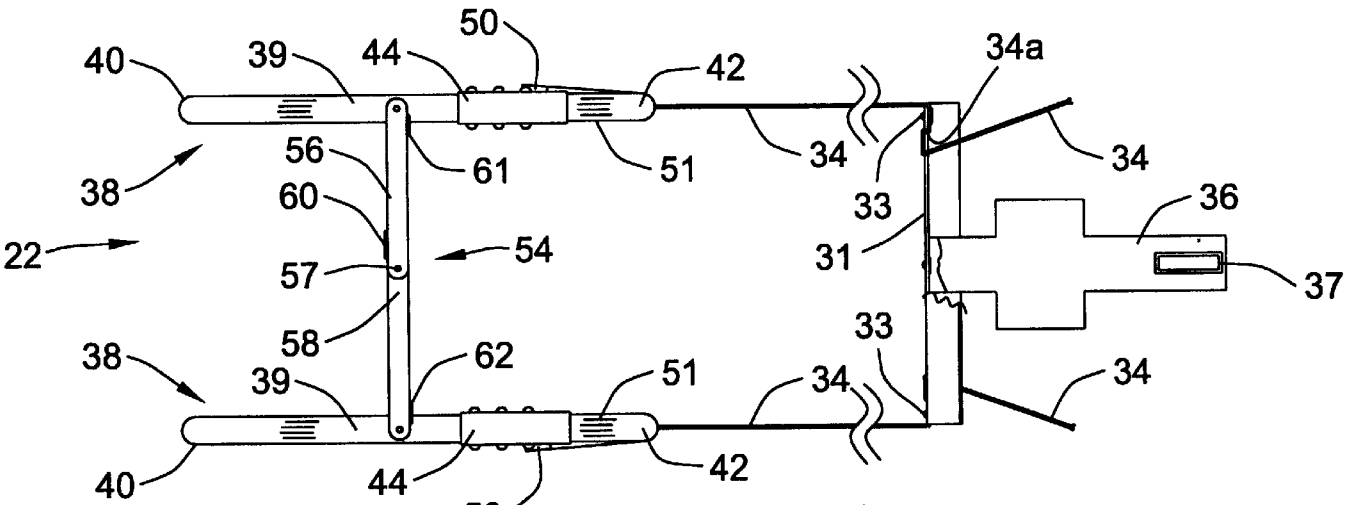
FIG. 3 is a top view of the escape ladder of FIG. 2.

Turning to FIGS. 2 and 3, side and top views of the preferred embodiment of escape ladder 20 are shown. Each of the rungs 30 of ladder assembly 24 includes a tread portion 31 and a standoff 32. The tread portion 31 provides a surface for receiving a person's foot during egress, while standoffs 32 space the rungs 30, and hence ladder assembly 24, away from the wall 27 for safe egress. As best seen in FIGS. 1 and 3, straps 34 are strung through slots or apertures 34*a* in the tread portion 31 of rungs 30 to form ladder assembly 24. Rungs 30 are attached in series to strap 34 at spaced locations with rivets 33. The rungs 30 are of similar cross-sectional shape such that they may be nested in a compact configuration providing easy storage of the escape ladder 20. The length of the rungs 30 provide space to receive strap material 34 when the rungs 30 are nested and the ladder assembly 24 is in the undeployed condition.

Securing strap 36 is attached to the uppermost rung 30 and is designed to encircle the nested rungs 30 to secure them in an un-deployed configuration. Securing strap 36 includes a fastener 37 for quick release of the nested rungs 30, thereby allowing the ladder assembly 24 to extend to its deployed condition as shown in FIGS. 1 and 2. In the preferred embodiment, hook and loop fasteners such as that sold under the trademark Velcro® is used to form fastener 37, although other fasteners well known in the art may also be employed. The fast and simple release of the rungs 30 of the ladder assembly 24 inspires the confidence of the user when confronted with an emergency situation.

Also depicted in FIGS. 2 and 3, hook assembly 22 generally comprises a pair of laterally spaced clamps 38. Each clamp 38 comprises an upper hook 40 and a lower hook 42 which are formed of metal tubes in the preferred embodiment. The upper and lower hooks 40, 42 are connected via hinge 44. In the preferred embodiment, hinge 44 is designed as a U-shaped channel for receiving adjacent ends of hooks 40, 42. Upper hook 40 is rigidly attached to hinge 44 by virtue of a pair of rivet 46, 47. Lower hook 42 is pivotally attached to hinge 44 via a single rivet 48. Thus lower hook 42 is allowed to rotate relative to hinge 44 and upper hook 40, which thereby allows the hook assembly 22 to clamp wall 27 between the free ends 41, 43 of upper hook 40 and lower hook 42, respectively. The free ends 41 43 of upper hook and lower hook 40, 42 include caps 50 for safe and secure attachment to wall 27, as well as to minimize the possibility of damage to wall 27. Lower hooks 42 of both clamps 38 each include a U-bolt 52 for attachment to the respective straps 34 of ladder assembly 24.

Clamps 38 are connected via stabilizer bar 54, as best seen in FIGS. 3 and 4. Stabilizer bar 54 comprises two hinged portions, left stabilizer 56 and right stabilizer 58, which permit the hook assembly 22 to fold into a compact package for storage. Left stabilizer 56 and a right stabilizer 58 are pivotally connected to each other via rivet 57. Left stabilizer 56 is also pivotally connected to hook 38, while right stabilizer 58 is pivotally connected to the opposing hook 38.

As best seen in FIG. 4, right stabilizer 58 includes a stop 60 extending orthogonal to the stabilizer bar 54 for limiting the rotational movement of left stabilizer 56 relative to right stabilizer 58. Furthermore, left stabilizer 56 includes a stop 61 extending orthogonal therefrom, positioned at an end proximate clamp 38 to which left stabilizer 56 is attached. The location of stop 61 limits the rotational movement of left stabilizer relative to clamp 38, limiting left stabilizer 56 to a perpendicular position relative to upper hook 40 of clamp 38, best seen in FIG. 3. Likewise, right stabilizer 58 includes a stop 62 extending orthogonal therefrom at an end proximate the clamp 38 to which right stabilizer 58 is attached. Stop 62 restricts the rotational movement of right stabilizer 58 to a perpendicular position relative to clamp 38. FIG. 9 shows stabilizer bar 54 in a folded position. When unfolded, left stabilizer 56 and right stabilizer 58 rotate relative to clamps 38, as well as relative to each other. It can been seen that stops 61 and 62 prohibit the left stabilizer 56 and right stabilizer 58 from rotating beyond a position perpendicular to the upper hooks 40 of clamps 38. Stop 60 prevents left stabilizer 56 from rotating beyond a generally parallel relationship with right stabilizer 58. Thus, it can be seen that stabilizer bar 54 provides rigid attachment and proper positioning of the clamps 38 relative to each other, yet permits the hook assembly 22 of the present invention to be folded into a un-deployed condition that is compact for storage.

Turning to FIG. 5, a side view of the hook assembly 22 is shown attached to a generally vertical wall 70. Wall 70 has an inside surface 74, a top surface 76, and an outside surface 78. The two clamps 38 grasp wall 70 in identical fashion, and thus further discussion regarding the attachment of hook assembly 22 to wall 70 will be described with reference to a single clamp 38. It can be seen that free end 41 of upper hook 40 contacts inside surface 74 and free end 43 of lower hook 42 contacts outside surface 78 to clamp the wall 70 therebetween.

Upper hook 40 generally comprises a main portion 39 and a free end 41 which is bent relative to main portion 39. Main portion 39 is rigidly attached to the hinge 44 via rivets 46 and 47. The upper hook's free end 41 is angled relative to the main portion 39 of upper hook 40, and in the preferred embodiment is disposed at an angle of approximately 45°. Lower hook 42 generally comprises a main portion 49, and two ends bent relative to main portion 49 in the same direction, denoted herein as attached end 51 and free end 43. Attached end 51 is pivotally connected to the hinge 44 via rivet 48, and as shown in FIG. 5, extends substantially parallel to the main portion 39 of upper hook 40 when fully deployed. Main portion 49 of lower hook 42 is disposed generally perpendicular to attached end 51, and hence is generally perpendicular to the main portion 39 of upper hook 40 as well. Free end 43 of lower hook 42 is also angled relative to the main portion 49, and in the preferred embodiment is disposed at an angle of approximately 100°. Free end 43 projects away from main portion 49 of lower hook 42 an orthogonal distance L which is approximately as long as the distance which attached end 51 extends orthogonal to main portion 49 up to rivet 48 connecting attached end 51 to hinge 44.

A U-bolt 52 is mounted to the main portion 49 of lower hook 42 for attaching the ladder assembly 24 to the hook assembly 22, as shown in FIGS. 1 through 3. Arrow 72 represents the downward force placed on the lower hook 42 by the weight of ladder assembly 24 and any person supported thereon. A person may use the clamps 38 of the hook assembly 22 as hand holds to lower themselves from the window 25 to the ladder assembly 24. By virtue of the position of U-bolt 52 and the structure of clamp 38 described above, the force indicated by arrow 72 is transmitted through the clamp 38 to create two important forces. First, a tension force is created between the upper and lower hooks 40, 42 at hinge 44. Second, a compression force is created between the free ends 41, 43 of upper and lower hooks 40, 42 to clamp the wall 70 therebetween.

As U-bolt 52 is located outwardly from the distal tip of free end 43, an outwardly directed force is placed on the attached end 51 of lower hook 42, as the lower hook 42 would attempt to rotate clockwise about the contact point between free end 43 and the outside surface 78 of wall 70. Since upper hook 40 is secured to the inside surface 74 of wall 70, its main portion 39 opposes the aforementioned outwardly directed force and thus places the upper and lower hooks 40, 42 in tension at hinge 44. Therefore, the main portion 39 of upper hook 40 and the attached end 51 of lower hook 42 act as a unitary piece providing strength and rigidity to the clamp 38 and hook assembly 22.

A compression force is also created by the downward force 72 from ladder assembly 24. The structure of lower hook 42 described above dictates that the top portion 76 of wall 70 contacts the clamp 38 at some portion along upper hook 40. Since lower hook 42 is pivotally connected to hinge 44, the downward force 72 causes lower hook 42 to attempt to rotate clockwise relative to hinge 44 and upper hook 40. Thus, force 72 is transmitted to free end 43 of lower hook 42, forcing free end 43 inwardly towards wall 70 and towards free end 41 of upper clamp 40. Hence, a compression force between the free ends 41, 43 of upper and lower hooks 40, 42 is created, causing the clamp 38 to squeeze the wall 70 therebetween.

It can therefore be seen that the force 72 is transmitted through the clamp 38 to create a tension force between the hooks 40, 42 at hinge 44, causing the portions of the hooks 40, 42 attached to hinge 44 to be positioned generally parallel to one another and act as a unitary piece providing strength and rigidity to the clamp 38. Force 72 is also transmitted through the clamp 38 to create a compression force between the free ends 41, 43 of upper and lower hooks 40, 42 ensuring that the hook assembly 22 is securely attached to wall 70.

FIGS. 6 and 7 illustrate the attachment of a clamp 38 of hook assembly 22 to a wall 70 that is thinner than the wall 70 depicted in FIG. 5. Referring to FIG. 6, as the clamp 38 is placed over wall 70, the downward force 72 causes lower hook 42 to rotate clockwise about hinge 44 towards the outside surface 78 of wall 70. At the same time, the outward location of force 72 relative to the contact point between the wall's upper surface 76 and upper hook 40 causes the clamp 38 to pivot about the contact point, rotating clamp 38 clockwise. Force 72 remains located outwardly from free end 43, and is thus transmitted through the lower hook 42 causing an outwardly directed force (described above) on attached end 51, thereby pulling upper hook 40 outwardly and into engagement with the inner surface 74 of wall 70. The force 72 also creates the compression force between free ends 41, 43 of upper and lower hooks 40, 42 and hence clamp 38 is securely attached to wall 70 as shown in FIG. 7.

Thus, despite the thinner wall 70, the clamps 38 of hook assembly 22 self-adjust their position relative to wall 70 to ensure that wall 70 is securely clamped therebetween. By virtue of the tension force, upper hook 40 properly engages the inner surface 74 and the main portion 39 remains substantially parallel to the attached portion 51 of lower hook 42, providing a clamp 38 having the strength and rigidity of a unitary piece. Further, the location of force 72 remains generally outward from free end 43 and hinge 44, providing the compression of upper and lower hooks 40, 42 ensuring that the hook assembly 22 is securely attached to wall 70.

Figure 10:
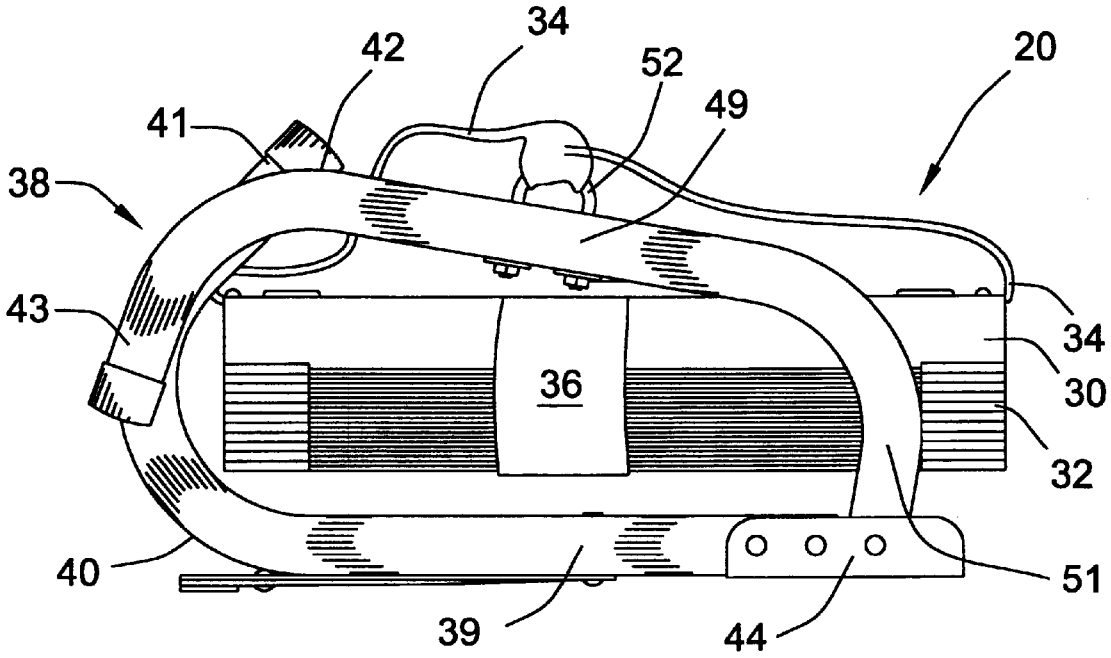
FIG. 10 is a top view of the escape ladder of FIG. 9.

It is a feature of the present invention that both the hook assembly and ladder assembly can each be placed into a small and compact un-deployed configuration, and furthermore that each of these un-deployed configurations are compatible with each other such that they may be combined into an un-deployed escape ladder package 20 that minimizes the space required to store the entire escape ladder 20. Referring to FIGS. 9 and 10, the un-deployed escape ladder package 20 is shown. The lower hook 42 rotates towards upper hook 40 to form the un-deployed configuration of the hook assembly 22, and the rungs 30 are nested to form the un-deployed configuration of the ladder assembly 24.

The attachment of the hooks 40, 42 to hinge 44 permits this overlapping of the upper and lower hooks 40, 42. As shown in the figures, the lower hook 42 and upper hook 40 are connected via hinge 44, which is generally U-shaped. FIGS. 8*a*, 8*b* and 8*c* illustrate the preferred embodiment of the hinge 44 which includes three aligned apertures 45 corresponding to rivets 46, 47, 48 for securing the upper and lower hooks 40, 42 to hinge 44. FIGS. 8*b* and 8*c* correspond with the associated cross-sectional cuts in FIG. 8*a*. As shown in FIG. 8*b*, the axis 84 of the upper hook 40 is vertically disposed, and the apertures 80 of the upper hook 40 have a centerline 90 that is slightly offset from a horizontal axis perpendicular to the vertical hook axis 84. In the preferred embodiment, this offset is approximately 4.5°. Unlike the upper hook 40, lower hook 42 includes apertures 82 having a centerline 92 perpendicular to the lower hook's axis 86 as shown in FIG. 8*c*. Therefore, when the lower hook 42 is connected to the hinge 44, as shown in FIG. 8*c*, the axis 86 of lower hook 42 is offset and pivots about the offset axis 92, skewed 4.5° from horizontal.

To better illustrate the point, the angle between the upper hook's axis 84 (which is vertical) and its aperture centerline 90 is denoted $\theta_u$ in FIG. 8*b*. Here, $\theta_u$ is about 94.5°. The angle between the lower hook's axis 86 and its aperture centerline 90 is denoted $\theta_L$ in FIG. 8*c* which is about 90°. Comparing $\theta_u$ to $\theta_L$ it can be seen that the upper hook's aperture centerline 90 is offset 4.5°. Thus when the upper hook 40 is vertical and the hinge 44 is attached via apertures 80, the hinge 44 is slightly offset relative to vertical (and horizontal), so that when lower hook 42 is pivotally attached to hinge 44, it pivots about an offset axis 92.

As best seen in FIG. 4, when the hooks 40, 42 are connected to the hinge 44 via rivets 46, 47, 48, the lower hook 42 pivots about an axis offset from the upper hook 40. In FIG. 4, it can be seen that the offset apertures 80 in the upper hooks 40 translates into the lower hooks 42 pivoting about an offset axis, as the lower hooks 42 are angled at about 4.5° outward from vertical, making the upper hooks 40 partially visible in FIG. 4. When the lower hook 42 is rotated towards upper hook 40 to form the un-deployed configuration of the hook assembly 22, the lower hook 42 rotates about the offset axis so that free end 43 of lower hook 42 can overlap free end 41 of the upper hook 40. While this offset axis is generally enough to permit the overlapping of the upper and lower hooks 40, 42, the hinge's width may be somewhat larger than the diameter of attached end 51 that is received by the hinge 44, such that lower hook 42 is given some sideplay. In this case, the offset axis of rotation, in combination with the sideplay, permits the compact un-deployed configuration of the escape ladder 20 shown in FIGS. 9 and 10. It can therefore be seen that the pivotal attachment of lower hook 42 to hinge 44 allows the clamps 38 to fall back on themselves, i.e. the upper and lower hooks 40, 42 pass each other to form a compact, un-deployed configuration of the hook assembly 22, and importantly an un-deployed configuration that is compatible with the un-deployed configuration of the ladder assembly 24.

As previously discussed, the rungs 30 have a common cross-sectional shape so that they may be nested to form the un-deployed configuration of the ladder assembly 24, as shown in FIG. 9 and best seen in FIG. 10. Excess strap material 34 that extends between the rungs 30 is contained between the rungs 30 along their length. Securing strap 36 is wrapped around the nested rungs 30 and secured by fastener 37 to maintain the nested condition of the rungs 30.

When the ladder assembly 24 and the hook assembly 22 are both in their un-deployed configurations, they may be assembled together to form an escape ladder package 20 as shown in FIGS. 9 and 10. The un-deployed assemblies are compatible and comport with each other to form a very compact escape ladder package 20 as will be herein described. As shown, particularly in FIG. 10, the un-deployed hook assembly has a cross sectional area which approximates the cross sectional area of the un-deployed ladder assembly, with the result that the two assemblies can partly nest and partly overlie each other to form a compact package for storage. The nested rungs 30 may be positioned relative to the hook assembly 22 such that the standoffs 32 extend towards the un-deployed hook assembly 22. More particularly, one of the two series of standoffs 32 may extend into the central opening defined by the overlapping upper and lower hooks 40, 42, indicated by dotted lines in FIG. 9. Further, the un-deployed hook assembly 22 may be slid laterally and positioned proximate the exposed series of standoffs 32. It can therefore be seen that the un-deployed configurations of the hook assembly 22 and the ladder assembly 24 are compatible with each other, and combine to form an escape ladder package 20 that is compact, reducing the space needed for storage.

To deploy the un-deployed escape ladder package 20, the hook assembly 22 is first deployed. The clamps 38 are moved away from each other as stabilizer bar 54 is extended. The stops 60, 61, 62 position the clamps 38 in a generally parallel relationship, the stabilizer bar 54 generally perpendicular to the clamps 38. The clamps 38 are unfolded as lower hooks 42 are rotated away from upper hooks 40. The hook assembly 22 is placed over the wall 27 so that the free ends 41 of upper hooks 40 contact the inside surface of wall 27, and the free ends 43 of lower hooks 42 contact the outside surface of wall 27. The fastener 37 of securing strap 36 is then released, permitting the ladder assembly 24 to extend downward under its own weight and into the deployed configuration shown in FIGS. 1 and 2. A person may then grasp the hook assembly 22 and lower themselves onto the ladder assembly 24 for safe egress from the dwelling.

The foregoing has described in detail an escape ladder for emergency egress from a dwelling which provides secure attachment to the dwelling, folds into an un-deployed package that is small and compact for storage, yet is assembled to provide user-friendly deployment that can be reliably deployed in a high stress situation. The hook assembly not only folds into an un-deployed configuration that is compatible with the nested rungs of the un-deployed ladder assembly to reduce the overall size of the un-deployed escape ladder package, but also provides the wall attachment reliability of a large unitary hook design.

What is claimed is:

1. An escape ladder for attachment to a dwelling wall at a window to provide egress from the dwelling, the escape ladder comprising:

a ladder assembly having a pair of straps and a series of rungs extending between the straps;

a hook assembly connected to the ladder assembly, the hook assembly having a pair of laterally spaced clamps, each of the clamps comprising an upper hook and a lower hook, the upper hooks and lower hooks each including a first end and an opposing second end, the upper and lower hooks pivotally connected by a hinge, the hinge comprising a U-shaped channel receiving the first end of the upper and lower hooks within the channel to limit the relative rotation of the upper and lower hooks, the lower hook being disposed in a first plane defined by the shape of the lower hook and the upper hook being disposed in a second plane defined by the shape of the upper hook; and the second plane being non-parallel to the first plane, wherein the upper and lower hooks rotate towards each other and overlap when the hook assembly is placed in an un-deployed configuration.

2. The escape ladder of claim 1, wherein an intersection of the first and second planes defines a hinge axis, the lower hook pivoting about a pivot axis which is perpendicular to the hinge axis.

3. The escape ladder of claim 1, wherein an outer diameter of the lower hook is sized relative to the channel diameter of the hinge to assist the lower hook pivoting to overlap the upper hook in the un-deployed configuration.

4. The escape ladder of claim 1, wherein the second ends of the upper hooks are angled towards the lower hooks, the first and second ends of the lower hook are angled towards the upper hooks, and wherein the escape ladder, in a deployed configuration, is structured for the upper hooks to contact a top surface of the wall, the second end of the upper hooks to engage the inside surface of the wall and the second ends of the lower hooks to engage the outside surface of the wall, and wherein the straps of the ladder assembly are attached to the lower hooks of the clamps, the ladder assembly exerting a downward force on the lower hooks, the downward force transmitted through the clamps to create a tension force between the first ends of the upper and lower hooks and a compression force between the second ends of the upper and lower hooks.

5. The escape ladder of claim 1, wherein the upper hook is rigidly attached to the hinge and the lower hook is pivotally attached to the hinge.

6. The escape ladder of claims 1, wherein the intersection of the first and second planes defines a hinge axis, and wherein one of the upper and lower hooks pivots about a pivot axis, the pivot axis being perpendicular to the hinge axis.

7. The escape ladder of claim 1, wherein the first and second planes are non-parallel as defined by an angle $\alpha$, $\alpha$ remaining substantially constant as the upper and lower hooks rotate relative to each other.

8. An escape ladder for attachment to a dwelling wall at a window to provide egress from the dwelling, the escape ladder comprising:

a ladder assembly having a pair of straps and a series of rungs extending between the straps;

a hook assembly connected to the ladder assembly, the hook assembly having a pair of laterally spaced clamps, each of the clamps comprising an upper hook and a lower hook, the upper and lower hooks pivotally connected by a hinge, the hinge comprising a generally U-shaped channel having a hinge axis, the hinge receiving first ends of the upper and lower hooks within the channel to limit the relative rotation of the upper and lower hooks to a maximum degree corresponding to a deployed configuration of the hook assembly, the lower hook being disposed in a first plane defined by the shape of the lower hook and the upper hook being disposed in a second plane defined by the shape of the upper hook; and the second plane being non-parallel to the first plane, wherein the upper and lower hooks rotate towards each other and overlap when the hook assembly is placed in an un-deployed configuration.

9. An escape ladder for attachment to a dwelling wall at a window to provide egress from the dwelling, the escape ladder comprising:

a ladder assembly having a pair of supports and a series of rungs extending between the supports;

a hook assembly connected to the ladder assembly, the hook assembly having a pair of laterally spaced clamps, each of the clamps comprising an upper hook and a lower hook, the upper and lower hooks pivotally connected by a hinge for rotation towards each other to form an un-deployed configuration where the upper and lower hooks overlap;

the hinge comprising an elongate channel defining a hinge axis, the hinge receiving first ends of the upper and lower hooks within the channel;

the shape of the lower hook defining a first plane and the shape of the upper hook defining a second plane non-parallel to the first plane;

the hinge axis being non-parallel to both the first and second planes.

10. The escape ladder of claim 9, wherein one of the upper and lower hooks pivots about a pivot axis, the pivot axis being perpendicular to the hinge axis.

11. The escape ladder of claim 9, wherein one of the upper and lower hooks pivots, the lower hook pivoting within the first plane and the upper hook pivoting within the second plane.

12. The escape ladder of claim 9, wherein one of the upper and lower hooks pivots about a pivot axis while the other hook is fixed to the hinge, the pivot axis being non-perpendicular to the plane defined by the hook fixed to the hinge.

13. The escape ladder of claim 9, wherein the first ends of the upper and lower hooks are spaced along the hinge axis.

14. The escape ladder of claim 9, wherein the lower hook pivots about a pivot axis, the pivot axis being non-perpendicular to the second plane.

15. The escape ladder of claim 9, wherein the lower hook pivots about a pivot axis, the pivot axis being perpendicular to the hinge axis.

16. The escape ladder of claim 9, wherein the first and second planes are non-parallel as defined by an angle $\alpha$, $\alpha$ remaining substantially constant as the upper and lower hooks rotate relative to each other.

17. The escape ladder of claim 16, wherein $\alpha$ is less than about 5 degrees.

18. The escape ladder of claim 9, wherein the channel is connected to the first ends of the upper and lower hooks to limit the relative rotation of therebetween to a maximum degree corresponding to a deployed configuration of the hook assembly.

* * * * *

UNITED STATES PATENT AND TRADEMARK OFFICE

CERTIFICATE OF CORRECTION

PATENT NO. : 6,530,455 B1
DATED : March 11, 2003
INVENTOR(S) : Arnette et al.

It is certified that error appears in the above-identified patent and that said Letters Patent is hereby corrected as shown below:

Title page,
Item [73], Assignee, "Meband, NC" should read -- Mebane, NC --

Drawings,
Sheet 5, Figure 8b, the lead line for reference numeral 80 should lead to the aperture.
Sheet 5, Figure 8c, reference numeral 80 should be 82 and the lead line should lead to the aperture.

Signed and Sealed this

Eleventh Day of November, 2003

JAMES E. ROGAN
*Director of the United States Patent and Trademark Office*